United States Patent [19]

Erickson

[11] 4,433,989

[45] Feb. 28, 1984

[54] AIR SEPARATION WITH MEDIUM PRESSURE ENRICHMENT

[76] Inventor: Donald C. Erickson, 1704 S. Harbor La., Annapolis, Md. 21401

[21] Appl. No.: 416,980

[22] Filed: Sep. 13, 1982

[51] Int. Cl.[3] ..... F25J 3/04

[52] U.S. Cl. ..... 62/13; 62/22; 62/28; 62/30; 62/31; 62/33; 62/34; 62/42

[58] Field of Search ..... 62/22, 23, 24, 27, 28, 62/29, 30, 31, 32, 33, 34, 42, 38, 39, 13

[56] References Cited

U.S. PATENT DOCUMENTS

| | | | |
|---|---|---|---|
| 2,699,046 | 1/1955 | Etienne | 62/29 |
| 3,500,651 | 3/1970 | Becker | 62/29 |
| 4,254,629 | 3/1981 | Olszewski | 62/29 |

*Primary Examiner*—Frank Sever

[57] ABSTRACT

A cryogenic air separation process is disclosed wherein the low pressure column section of a doubler is caused to operate closer to equilibrium and, hence, more efficiently by incorporating a medium pressure column which further enriches HP column enriched oxygen liquid before introduction into the LP column. The MP column is reboiled by indirect heat exchange with condensing HP column nitrogen, and is refluxed by direct injection of condensed nitrogen.

A second improvement to cryogenic air separation is disclosed which can be advantageously combined with the above improvement, in which pressurized oxygen up to 10 ATA is efficiently produced from pumped LOX by using the pumped LOX to reflux an auxiliary higher pressure column in which a fraction of the supply air compressed to higher pressure is separated into liquid $N_2$ which is subsequently used as reflux and into oxygen enriched liquid which is further separated.

7 Claims, 3 Drawing Figures

AIR SEPARATION WITH MEDIUM PRESSURE ENRICHMENT

DESCRIPTION

1. Technical Field

This invention relates to processes and apparatus for the separation by subambient distillation of mixtures of noncondensible gases such as air.

The cryogenic distillation step incorporated in conventional air separation processes is characteristically inefficient due to the composition of the liquids fed to the LP column. A more efficient distillation would provide any of a variety of benefits—lower the overall energy consumption, increase product and/or by-product recovery and/or purity, or decrease size and cost of equipment.

Pressurization of product oxygen to elevated use pressure via compressor is both inefficient and potentially hazardous. Pressurization schemes involving pumping and subsequent gasification of liquid oxygen are safer but even less efficient. Thus, a need exists for a pumped LOX system at least as efficient as the $O_2$ compressor system.

2. Background Art

The prior art for this invention, U.S. Pat. No. 4,254,629, describes via a McCabe-Thiele diagram why the typical approximately 41% oxygen liquid feed to the low pressure portion of a conventional doubler column leads to inefficient operation. This is because that feed composition causes much of the column to operate very far from equilibrium. The patent further discloses that introducing at least part of the feed to the LP column as approximately 40% $O_2$ vapor vice liquid causes the lower column to operate much closer to equilibrium, i.e., more efficiently. Two methods are disclosed for obtaining the approximately 40% $O_2$ vapor. Both require an auxiliary column receiving supply air at a pressure somewhat below the pressure of the HP portion of the doubler column. In one approach, a reflux condenser refluxes the auxiliary column while gasifying approximately half the 41% liquid to 41% vapor. In the other case, a separate rectification column operating at a medium pressure refluxes the auxiliary column while generating both $N_2$ vapor and approximately 41% $O_2$ vapor.

The disadvantages with the prior art disclosure include the following. First, only part of the fluid feed to the LP column is enriched to a composition which allows operation closer to equilibrium—if all the 41% $O_2$ liquid were so enriched, even greater efficiency improvement would be obtained. Secondly, in the LP column a liquid containing approximately 70% $O_2$ is in equilibrium with a gas containing 41% $O_2$. Hence, the improvement in LP column operation in regard to operation closer to equilibrium is obtained equally as effectively by supplying the LP column with 70% $O_2$ liquid as with 41% $O_2$ vapor. However, there are mechanical advantages to the former, such as, rejecting more $N_2$ at the medium pressure where it is available to drive the expander and where it allows smaller LP column vapor flow rates. Thirdly, the prior art requires two different supply air pressures, which are provided either by two separate compressors or by one compressor plus an added expander. Finally, the prior art process is only capable of producing a low purity $O_2$ product, e.g., less than 99.5%.

The prior art for an additional aspect of this invention, relating to production of high pressure oxygen, appears in the following two technical articles: "The Production of High-Pressure Oxygen" by Helmut Springmann, *Linde Reports on Science and Technology,* 31/1980, Linde, A. G.; and "Large Oxygen Plant Economics and Reliability", by William J. Scharle, Tennessee Valley Authority Publication TVA Y 143, July 1979, pages 98–108. The former article describes the hazardous nature and relatively low efficiency of oxygen compressors relative to air compressors (e.g., 66% vice 76% efficiency) due to the lower ignition temperature of metals in pressurized oxygen. Both articles describe alternative "pumped LOX" cycles wherein liquid oxygen is pumped to high pressure and then gasified against condensing supply air at high pressure. Both articles characterize this as a less hazardous yet markedly less efficient (8% less) approach to pressurized oxygen. The inefficiency of the "Pumped LOX" cycles utilizing split feed air pressures is due to the fact that the prior art cycles wastefully condense the higher pressure fraction of supply air directly to liquid air, as opposed to the combination of liquid nitrogen and oxygen enriched (~41%) liquid which is obtained from the lower pressure fraction in the HP portion of the doubler column. Thus, since less separation is achieved in the liquid state, e.g., less reflux $N_2$ liquid is available and the enrichment of the oxygen enriched liquid is lower, there will be correspondingly less separation and, hence, recovery and/or purity achieved in the LP column.

"Doubler" signifies the conventional dual pressure column in which the reflux section of the high pressure column is in indirect heat exchange relation with the reboil section of the low pressure column.

DISCLOSURE OF INVENTION

This invention consists of two separate improvements to air separation and pressurized oxygen production, each of which yields an advantageous and unexpected result independently of the other. Furthermore, the two separate improvements are combinable whereby a special cooperative effect is obtained yielding an even more advantageous result than possible with either taken alone.

The need addressed by the air separation improvement is the provision of an improved higher effeciency subambient distillation arrangement which (a) requires only a single feed pressure, thus, avoiding the need for a second compressor or expander and for a separate HP column operating at slightly reduced pressure; which (b) allows further enrichment of essentially all the enriched oxygen liquid from the HP column before introduction to the LP column; which (c) allows the production of high purity (>99.5% $O_2$) product; and which (d) provides the enhanced $O_2$ enrichment fluid to the LP column in either vapor or liquid state (including combinations thereof).

The need addressed by the pressurized oxygen production improvement is the provision of apparatus or process steps which allow the higher pressure fraction of supply air to condense against boiling LOX so as to yield two separate liquid streams, one of nearly pure $N_2$ and the other of enriched oxygen liquid, thereby making the liquid $N_2$ available as reflux in the remaining distillative apparatus, as well as providing an enriched oxygen feed. Thus, the remaining distillations will yield greater separation than when they are supplied simply with liquified air.

The needed air separation improvement is fulfilled by adding a medium pressure column to a dual pressure column process wherein essentially all the enriched liquid from the high pressure column is further enriched in the medium pressure column, before being routed into the low pressure column; and the MP column is reboiled by indirect heat exchange against the HP column (similarly to the LP column); and the MP column is refluxed by direct injection of liquid $N_2$ at the top (again similar to the LP column). The relatively pure gaseous overhead product (>98% $N_2$) is thus at medium pressure, and can be partially warmed and work expanded to produce process refrigeration. This avoids the need for wastefully extracting air or $N_2$ from the high pressure column for refrigeration.

When the medium pressure enrichment arrangement of columns is used to produce high purity oxygen, the MP column pressure will be in the range 3 to 4 ATA and the gaseous molar flow rate through the MP column will be in the range of 20 to 34% of the feed air supply rate. It is also important that the enriched oxygen fluid withdrawn from the MP column be essentially all in the liquid phase. This is necessary in order to maximize the LP column reboil which is necessary to strip argon out of the oxygen. Under the above restrictions, the enriched liquid withdrawn from the MP column will contain between 50 and 65% $O_2$. This liquid may be used to reflux the auxiliary argon column, in which case approximately half or more will be gasified, and a mixture of very approximately 70% $O_2$ liquid plus 40% $O_2$ vapor would be further routed to the LP column. Alternatively, the argon column could be refluxed by indirect heat exchange with boiling liquid $N_2$—this has the advantage that the gaseous $N_2$ is produced at the same pressure as the MP column, and, hence, can be combined with the MP column overhead to drive the expander. Obviously, combinations of the above or completely different schemes can be used to reflux the argon column.

The needed pressurized oxygen production improvement is fulfilled by providing an auxiliary higher pressure column which receives the higher pressure fraction of air (i.e., the fraction compressed beyond high pressure) and which is refluxed by indirect heat exchange with the boiling pressurized LOX. The higher pressure air is introduced near the bottom, and liquid $N_2$ is withdrawn from the top and enriched oxygen liquid is withdrawn from the bottom. This higher pressure auxiliary column can be combined with any desired distillation arrangement for treating the remaining fraction of air, e.g., with a conventional dual pressure column. Thus, the liquid $N_2$ from the higher pressure column adds to the reflux available to the remaining distillation apparatus, providing greater separation power. The enriched oxygen liquid from the higher pressure column would advantageously be routed through a high pressure column where it would undergo slight additional enrichment prior to introduction to the LP column. Mechanical energy could advantageously be recovered from the depressurization of either or both liquid streams.

Mechanical recovery in a flashing liquid expander or similar two phase work-producing pressure reduction means will be particularly advantageous in this process. This is because volumetrically at least one and a half moles of air must be compressed to higher pressure for every mole of $O_2$ gasified. The savings is due to the air requiring a substantially lower pressure ratio boost than the oxygen. However, insufficient liquid oxygen will be available to fully cool the two liquid streams from the air. Thus, substantial gas will be generated in depressurizing the enriched oxygen liquid to HP column pressure, and a two phase expander can generate refrigeration, thus greatly reducing the need for additional refrigeration.

Since the higher pressure distillation column relies on evaporation and condensation for its functioning, it is limited to a pressure below the critical pressure of nitrogen, and, in practice to below about 28 ATA. This limits the maximum $O_2$ production pressure to approximately 10 ATA by this process, accounting for the reflux-reboil heat exchange temperature differential.

The pressurized oxygen production improvement described above will provide much greater separation power than the prior art pumped LOX processes, but there will still be some reduction in separation power as opposed to a process producing only low pressure gaseous oxygen. On the other hand, the air separation improvement described above will provide greater separation power than that present in a conventional low pressure gaseous oxygen process. Thus, a particularly advantageous result is obtained from the combination of the two above improvements, where the extra separation power in the one compensates for the reduced separation power available from the other. In this way, pressurized oxygen up to 10 ATA can be produced safely and efficiently with minimal or no reduction in recovery or purity and without the inefficiencies inherent to an $O_2$ compressor.

BEST MODE FOR CARRYING OUT THE INVENTION

Figure 1:
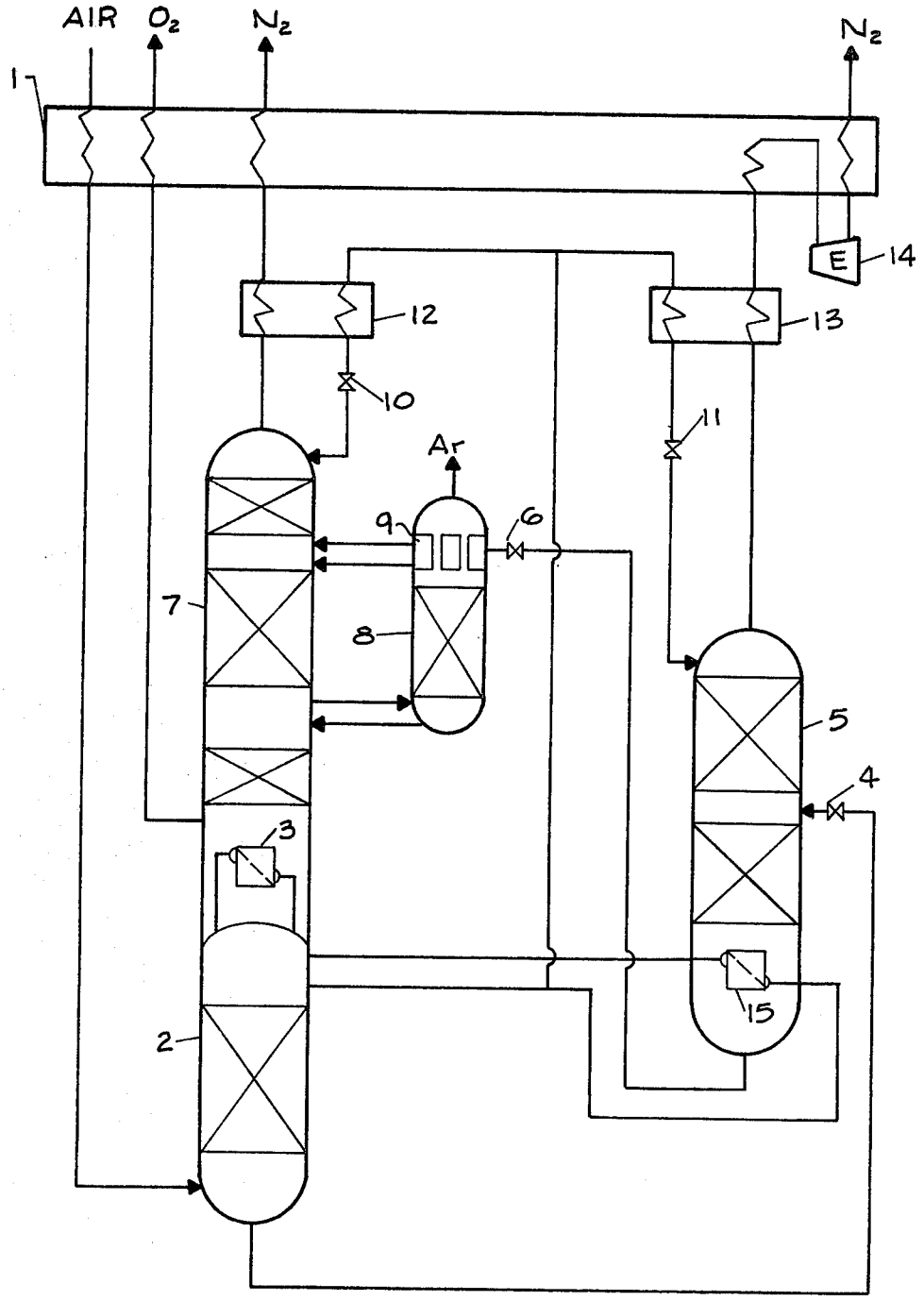
FIG. 1 is a simplified schematic flowsheet of an air separation process incorporating the medium pressure column in the manner disclosed.

Referring to FIG. 1, cleansed, pressurized air is supplied via heat exchange apparatus 1 to the high pressure section 2 of a doubler. That column is refluxed by reflux condenser 3, yielding liquid nitrogen at the top and approximately 41% oxygen enriched liquid at the bottom. The latter stream is routed through pressure reduction means 4 (and also optionally through sensible heat exchange devices) into medium pressure column 5. There it is distilled into a relatively pure overhead gaseous nitrogen (>98%) and further enriched bottom product liquid. The MP column is reboiled by indirect exchange of heat with condensing overhead gas from the HP column. With the HP column top at 6.4 AT A (1 ATA=1.013 bar) and 97.7 K., and a 2 K. $\Delta T$ across both reflux/reboilers, the MP column bottom will be at 95.7 K., 3.55 ATA, and 54 mole percent $O_2$ liquid. That liquid is routed via optional sensible heat exchange device to means for pressure reduction 6. That fluid is eventually routed to LP column 7; however, if an auxiliary argon removal column 8 is present, it is routed via the top reflux section 9 of that column. Somewhat more than half of the 55% $O_2$ liquid would be gasified to a mixture of approximately 70% liquid and 40% vapor at 90 K and 1.75 ATA. The argon column overhead thus operates at 92 K, 1.5 ATA, and at least 70% argon. The argon product may be optionally further purified before final delivery, as is conventionally done.

The liquid $N_2$ produced in refluxers 3 and 15 is split between and directly injected into columns 5 and 7 as reflux via the action of pressure reducing mechanisms 10 and 11. Those streams would normally be sensibly cooled by heat exchange with gaseous overhead $N_2$ in heat exchangers 12 and 13 before injection as reflux. The gaseous $N_2$ from column 5, which amounts to approximately 27% of the molar feed air supply rate in this example, is further warmed and then work expanded in expansion device 14, thereby providing process refrigeration. The heat exchanger 1 can be any known type—reversing, pebble bed, etc., to suit product requirements or local conditions. The means for pressure reduction 4, 6, 10, and 11 can be any of J-T valves or orifices, control valves, hydraulic expanders, or the like. The flowsheet merely illustrates the interrelationships of the novel aspects of the disclosure, and is not intended to illustrate conventional components such as air compressor, air cleanup, hydrocarbon adsorber, etc.

It will further be apparent that the novel subambient distillation arangement incorporating a medium pressure column in the manner disclosed is applicable to other separations in addition to air. For example, it can be applied to $N_2$-$CH_4$ separation, $CH_4$-$C_2H_6$ separation and others. Also, the expansion of the MP column overhead gas is not an essential aspect of the novelty, as in some cases it will be desired to produce that gas at pressure. Obviously, pressures, temperatures, and compositions other than those cited would be applicable in other circumstances, even for air separation. The example cited is predicated upon discharging waste $N_2$ to atmosphere, which sets the LP column overhead pressure at about 1.5 ATA when reversing exchangers are used for cleanup. It will be recognized that still other variations are possible within the scope of the disclosure, e.g., supplying two separate HP columns rather than one having combined duty, which could be supplied with single pressure air or in some cases even with split pressure air. Some product may be withdrawn as liquid; different purity $N_2$ streams may be separately withdrawn; different or additional sensible heat exchangers may be incorporated; all within the scope of the claimed novelty.

Figure 2:
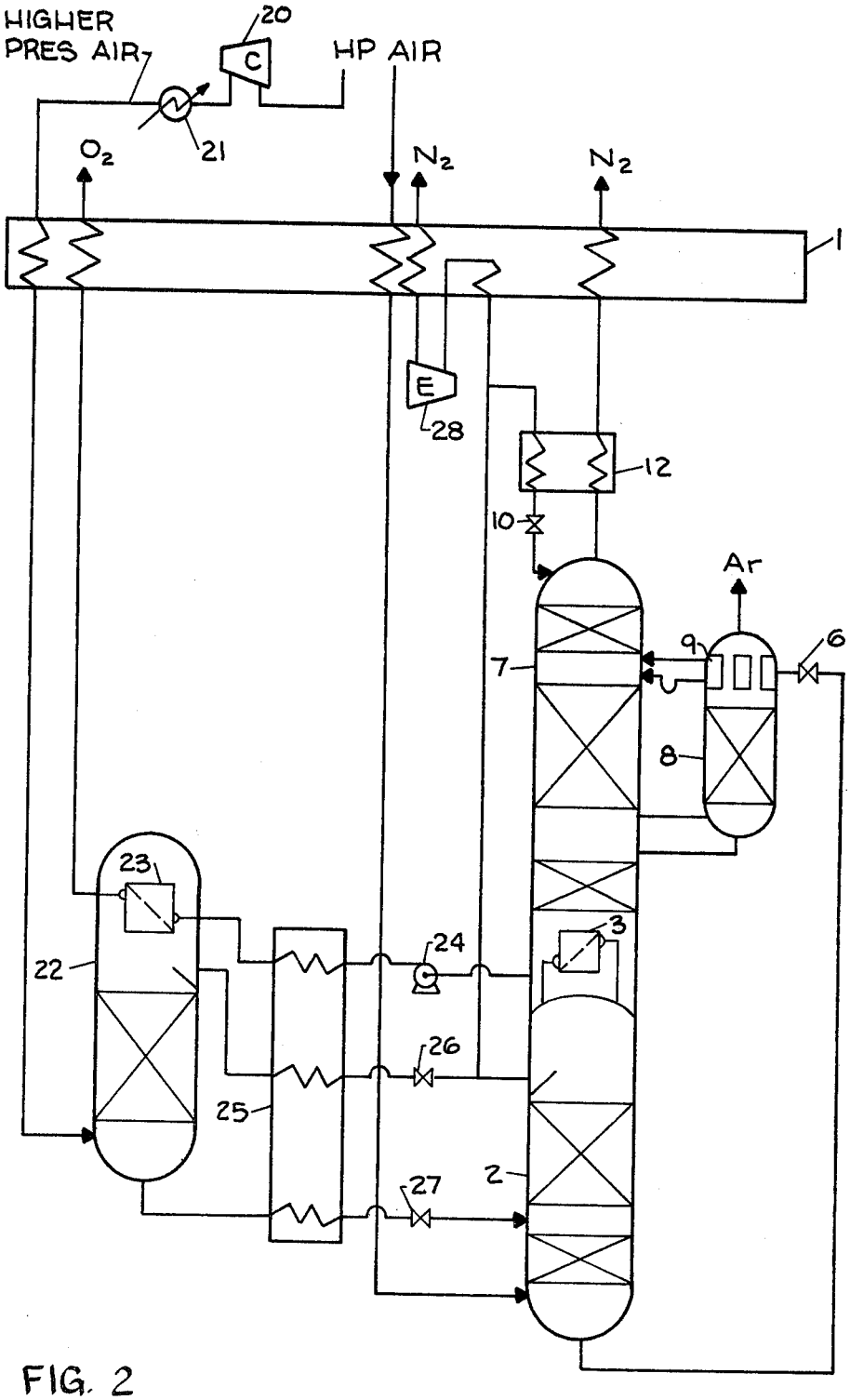
FIG. 2 illustrates a conventional dual pressure column process incorporating a higher pressure column for gasification of pressurized pumped LOX (liquid oxygen).

FIG. 2 illustrates a conventional dual pressure column 2 and 7, with auxiliary argon removal column 8, and with other conventional features 1, 3, 6, 9, 10, and 12 similar in function to the same numbered components of FIG. 1. The equipment that distinguishes this flowsheet from FIG. 1, in addition to the absence of the medium pressure column and associated equipment, consists of the following. Part of the feed air, between 25 and 45%, is further compressed to a higher pressure in compressor 20, and then cooled (plus otherwise cleaned, if necessary) in cooler-cleaner 21, and further regeneratively cooled to near its dewpoint in heat exchanger 1. It is introduced near the bottom of higher pressure column 22. This column is refluxed by indirect heat exchange with boiling pressurized liquid oxygen in refluxer 23. The pressurized LOX is obtained from LP column 7 via pump 24 and heat exchanger 25. The higher pressure air is thus distilled into two liquid streams: liquid $N_2$ and oxygen enriched liquid. These streams trade sensible heat with the previously mentioned LOX in heat exchanger 25, and then are let down in pressure via means for pressure reduction 26 and 27. The enriched oxygen liquid is expanded into HP column 2 for slight further enrichment, while the liquid $N_2$ is used as reflux in column 7. The LOX has substantially less heat capacity than the two liquid streams from column 22, and hence, their pressure reduction will entail considerable gas evolution. Hence, it is especially advantageous although not mandatory to use a two phase workproducing expansion device as the means for reducing pressure, particularly number 27. Various types of such devices are known, using the Lysholm or other configuration, e.g., p. 63 of *Chemical Engineering*, Sept. 6, 1982, McGraw Hill. Usually such expansion is not sufficient to produce the total refrigeration requirements, and a conventional $N_2$ powered expander 28 (or air powered one) will also be required.

Predicated on a 2 K. temperature differential refluxer 23, the following approximate pressure relations will prevail in the higher pressure column: 4 ATA $O_2$ product requires 12.8 ATA higher pressure air; 7 ATA $O_2$ requires 18 ATA; and 10 ATA $O_2$ requires 27 ATA air. Since the extra energy required by this technique is only the incremental compression above the high pressure level (typically 6.4 ATA), the required pressure ratio for this increase is much less than that required alternatively by an $O_2$ compressor. This compensates for the fact that substantially more air than $O_2$ must be so compressed. Considering the added advantage that air compressors are more efficient than $0_2$ compressors, this pumped LOX with higher pressure distillation ends up more efficient than compressed $O_2$ systems for $O_2$ pressures up to 120 psig even without a two phase expander.

Figure 3:
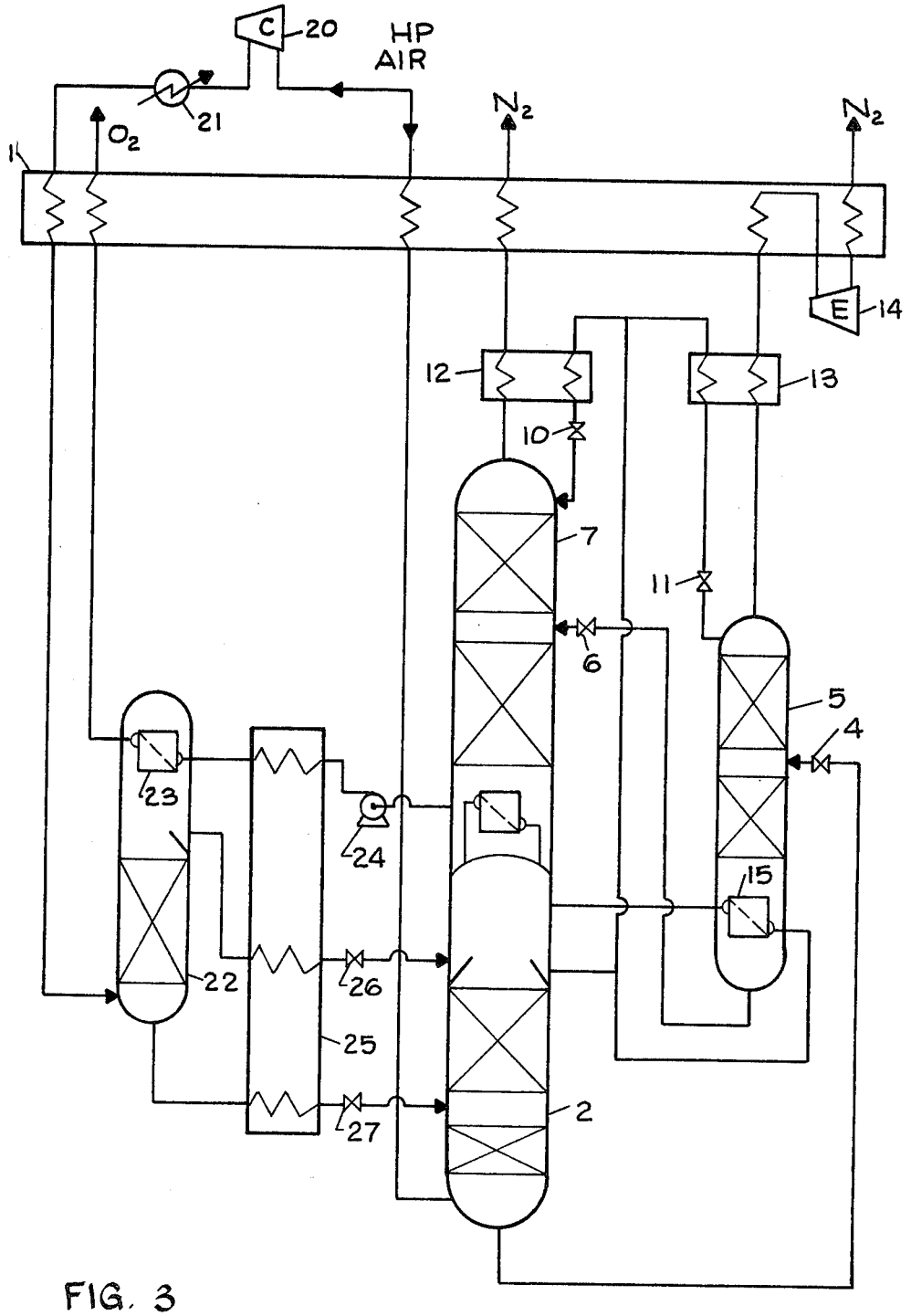
FIG. 3 illustrates a process combining both the above improvements.

Once again, alternative or additional sensible heat exchangers could be expected to be applied to the FIG. 2 flowsheet in specific cases, e.g., using some gaseous $N_2$ to provide further cooling to the liquid streams from the higher pressure column. Also many other variations are possible within the scope of the disclosure, e.g., details of the remaining subambient distillation process. An example of this is FIG. 3, wherein the pumped LOX with higher pressure distillation is combined with the medium pressure enrichment arrangement described earlier (FIG. 1). As explained earlier, this combination matches strengths of each against weaknesses of the other, thereby providing greater overall recovery, purity, and efficiency than possible with either alone. The numbered components in FIG. 3 correspond to the same numbered components described earlier in conjunction with either FIG. 1 or 2. The auxiliary argon removal column has been deleted from FIG. 3 merely to more clearly illustrate the novel aspects of the disclosure, as obviously the combination depicted in FIG. 3 would frequently be used in conjunction with such a column. Without the auxiliary column, the flowsheet would be limited to producing medium purity (98% or less) $O_2$, but with it production of high purity pressurized $O_2$ is possible.

I claim:

1. In a process for the subambient distillative separation of a mixture of noncondensable gases comprising distilling the feed mixture at a single supply pressure in at least one refluxed high pressure (HP) distillation column to a nearly pure overhead liquid and an enriched liquid containing the bottom product; further distilling at least one enriched fluid containing the bottom product in a reboiled low pressure (LP) column to nearly pure fluid bottom product and nearly pure gaseous overhead product including directly injecting at least part of said nearly pure overhead liquid into said LP column as reflux; and causing HP column reflux and LP column reboil by indirect heat exchange between the two columns, the improvement comprising;

(a) distilling a single supply pressure feed mixture in the HP column;

(b) providing a medium pressure (MP) distillation column operating at a pressure intermediate to said high and low pressures;

(c) distilling in the MP column essentially all the enriched liquid containing the bottom product produced by the HP column to a relatively pure gaseous overhead product at medium pressure and a further enriched fluid containing bottom product;

(d) refluxing the MP column by directly injecting part of said overhead liquid into the upper portion thereof;

(e) reboiling the MP column by indirect heat exchange with the HP column;

(f) routing the further enriched fluid obtained in step (b) into the LP column;

(g) recovering a bottom product from the LP column of up to 99.5% purity.

2. The process according to claim 1 further comprising partially warming and work expanding the medium pressure gaseous overhead product so as to provide process refrigeration.

3. The process according to claim 2 wherein the mixture being separated is air, the overhead product is $N_2$ and including the steps of cleaning, compressing, drying, and cooling the air to near its dew point.

4. The process according to claim 3 wherein the further enriched fluid withdrawn from the MP column is in liquid phase and is comprised of 50 to 65% oxygen.

5. The process according to claim 4 further comprising maintaining the MP column pressure between 3 and 4 ATA and maintaining the molar flowrate of the gaseous MP column overhead product between 20 and 34% of the feed air supply rate.

6. The process according to claim 5 further comprising providing a separate argon extraction column and refluxing that column by indirect heat exchange with evaporating further enriched liquid containing oxygen.

7. The process according to claim 3 further comprising supplying between 25 and 45% of the supply air at a higher pressure in the range of 10 to 28 ATA to a higher pressure column; refluxing said column by indirect heat exchange with boiling pumped liquid oxygen from the LP column; and supplying liquid $N_2$ from the higher pressure column as reflux to at least one of the other columns.

* * * * *